United States Patent [19]

Kitagawa et al.

[11] Patent Number: 4,566,499

[45] Date of Patent: Jan. 28, 1986

[54] JACQUARD MECHANISM

[75] Inventors: Hiroshi Kitagawa; Masaaki Sato; Mitsumasa Sawai, all of Nagoya; Takeo Yamamoku, Iwakura; Koichi Akatsuka, Tokyo; Toshio Metoki, Kawasaki, all of Japan

[73] Assignees: Mitsubishi Rayon Co., Ltd., Tokyo; Yamada Dobby Co., Ltd., Aichi, both of Japan

[21] Appl. No.: 674,166

[22] Filed: Nov. 23, 1984

[30] Foreign Application Priority Data

Nov. 24, 1983 [JP] Japan ..... 58-221336

[51] Int. Cl.[4] ..... D03C 3/20

[52] U.S. Cl. ..... 139/59; 139/68; 139/455

[58] Field of Search ..... 139/455, 59, 317, 318, 139/319

[56] References Cited

U.S. PATENT DOCUMENTS 3,103,953 9/1963 Lauritsen ..... 139/455
4,059,131 11/1977 Bucher ..... 139/59

FOREIGN PATENT DOCUMENTS 56-107878 8/1981 Japan .
57-18680 1/1982 Japan .
57-34587 2/1982 Japan .
57-34588 2/1982 Japan .
58-34973 3/1983 Japan .
58-87884 6/1983 Japan .

*Primary Examiner*—Henry S. Jaudon
*Attorney, Agent, or Firm*—Finnegan, Henderson, Farabow, Garrett & Dunner

[57] ABSTRACT

An electronic jacquard mechanism for controlling shedding motion of warps by selectively holding dropper needles by means of solenoids in accordance with command signals generated from a computer. Movable cores of the solenoids are directly fixed on one end of the dropper needles. Housings of the solenoids, including stationary cores and coils, are secured directly on a printed board associated with the computer. The solenoids can be densely arranged on the printed board corresponding to the arrangement of the dropper needles, allowing greater compactness of the mechanism.

8 Claims, 7 Drawing Figures

JACQUARD MECHANISM

BACKGROUND OF THE INVENTION

1. Field of the Invention

The present invention relates to a jacquard mechanism for controlling a shedding motion of warps set on a loom, particularly to an improvement of an electronic jacquard mechanism in which a solenoid of a needle selection device is directly operable by a command signal from a computer.

2. Description of the Related Art

In a traditional jacquard mechanism well-known in the art, specific dropper needles are selected at every pick of a weft in accordance with a position of a perforation on a pattern card.

In this jacequard mechanism, a large number of pattern cards, usually tens of thousands, are necessary for completing a pattern. These cards are connected one by one to form an endless belt and set in the mechanism so that they successively confront a selection device synchronously with a rotation of a main shaft. A considerable amount of space is needed for this. Also, the preparation of the pattern cards requires considerable time and labor. Further, setting and amending the cards are very troublesome. This problem is particularly, bothersome when just making samples of various weave patterns. It requires several months from the beginning of preparation of the pattern cards to the completion of the weaving on the loom.

Recently, to solve the problem, a so-called "electronic" jacquard mechanism utilizing a computer has been developed. In this mechanism, a magnetic tape or disc memories the pattern information and thus does away with the lengthy belt of pattern cards. Most such mechanisms further omit the dropper needles themselves to simplify the device. Instead, horizontal needles arranged in a final stage of the selection device are controlled by a solenoids.

This mechanism has, however, a serious drawback. Since the horizontal needles are urged to their waiting position by springs, an attactive force of at least 300 g.wt. is necessary to displace it or hold them in a selection position. This means the solnoids must be of a large capacity, therefore, large size. On the other hand, since a large number of horizontal needle, e.g., 1,000 to 2,000, are arranged in the jacquard mechanism for controlling the warps, the pitch between adjacent needles must be as small as possible to keep the overall installation small. Since the solenoids are large in size, however, they cannot be arranged at a small pitch corresponding to that of the horizontal needles. To solve this problem, the solenoids are disposed apart from the horizontal needles. The solenoids and needles are connected by flexible components such as steel wires or synthetic fiber cords. Due to repeated stress, however, the flexible components tend to stretch with the time, resulting in indefinite displacement of the horizontal needles. In the worst case, the flexible components break due to material fatigue.

In view of this drawback, the present inventors previously proposed a system in Japanese Unexamined Utility Model Publication (Kokai) Nos. 56-107878, 57-18680, 57-34587, 57-34973, and 58-87884 in which periodically reciprocating dropper needles are selectively attracted by corresponding solenoids. Because a much smaller force is required for operating dropper needles compared to horizontal needles in conventional mechanisms, solenoids of a smaller capacity and, therefore, a smaller size are sufficient and the compactness of the jacquard mechanism can be maintained without problem. The present invention is an improvement of this system.

SUMMARY OF THE INVENTION

It is an object of the present invention to provide a solenoid dropper-needle system offering stable control under high processing speeds and further compactness.

The above object of the present invention is achievable by a jacquard mechanism for controlling a shedding motion of warps set on a loom, including a plurality of axially displaceable dropper needles, each associated with a group of warps, and a plurality of solenoids, each corresponding to one of the dropper needles. A computer, storing the pattern information, issues commands to selectively energize the solenoids to hold the corresponding dropper needles. The mechanism of the present invention specifically includes a printed board on which a circuit for transmission of command signals from the computer to the solenoids is printed; solenoids including stationary cores, accommodated in housings secured, along with coils, directly on the printed board and disposed at predetermined positions along extensions of axes of the dropper needles, and movable cores, fixed to ends of the dropper needles closer to the stationary cores; means for periodically reciprocating all of the dropper needles along each longitudinal axis thereof from a first position where the movable and stationary cores are apart from each other at a predetermined distance to a second position where the movable and stationary cores substantially come into contact with each other; a guide plate provided with a plurality of holes for stably guiding the movable cores during thre reciprocation of the dropper needles; and means for urging the dropper needles toward the first position.

Preferably, the reciprocating means for the dropper needles includes a lifter plate for supporting the dropper needles at the ends opposite to those connected to the stationary cores, and cam means for moving the lifter plate.

More preferably, the lifter plate is covered with a resilient sheet on the surface receiving the dropper needles for compensating for variance of the actual distance between the first and second positions of the dropper needles.

Alternately, the lifter plate is provided with a plurality of cushion means on a surface receiving the dropper needles, the position of each means corresponding to that of the dropper needles.

Further, the dropper needles are preferably urged by compression springs toward the lifter plate for facilitating the return to the first position.

The solenoids may be arranged with alternating polarities of coils in each row.

Further, the housings of the solenoids preferably include a shield made of a ferro magnetic material for preventing leakage of magnetic flux therefrom.

The housings may be provided with marks at free end surfaces for identifying positions of beginning ends of the coils wound therearound.

The solenoids to be utilized in the present invention need only have an attractive force of 10 g.wt. and can be arranged on the printed board with a pitch in a range of from 4 mm or 5 mm.

BRIEF DESCRIPTION OF THE DRAWINGS

Further objects and advantages of the present invention will be apparent from the following description with reference to the attached drawings illustrating the preferred embodiments of the present invention, in which.

DESCRIPTION OF THE PREFERRED EMBODIMENTS

In this specification, in principle, the term "solenoid" means an assembly including a housing, in which a stationary core is accommodated and around which a coil is wound to encircle the stationary core, and a movable core, operating as a plunger, which is displaceable in the axial direction by the magnetic force of the stationary core generated by a current flowing through the coil. Sometimes, the term also designates only the stationary part thereof without the movable core. The distinction between the two will be apparent from the related description and the drawings.

Figure 1:
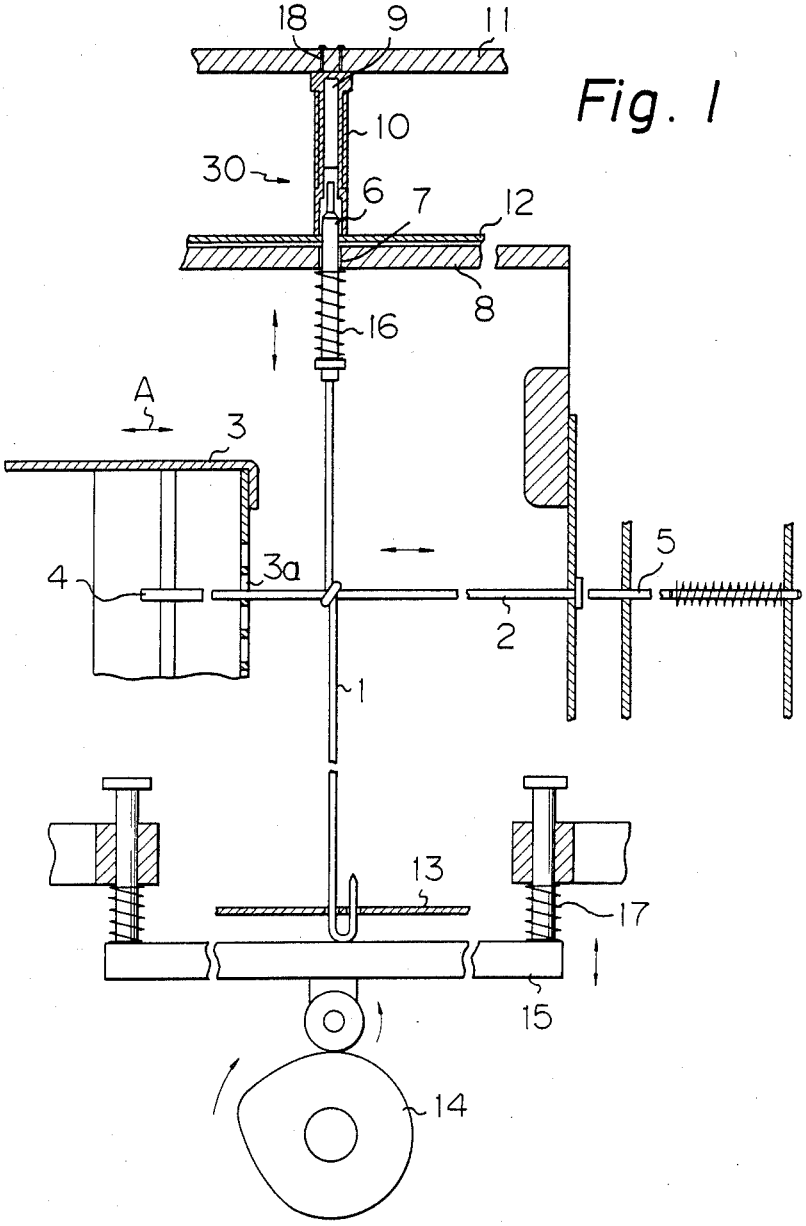
FIG. 1 is a diagrammatical sectional side view of an embodiment according to the present invention.

FIG. 1 illustrates the main part of the jacquard mechanism according to the present invention. The mechanism includes a plurality of vertically arranged dropper needles 1, though only one is illustrated in FIG. 1 to simplify the drawing. A hook-shaped lower end of the dropper needle 1 rests on a lifter plate 15 which is always downwardly urged by return springs 17 and is reciprocated through a definite distance in the vertical direction by means of a lifter cam 14 rotating sychronously with the rotation of a main shaft. Therefore, the dropper needle 1 can be moved from the lowest position (below, "first position") to the highest position (below, "second position"). The hooked end of the dropper needle 1 is loosely held in a slot provided in a hook plate 13 so as not to rotate about its own axis.

The dropper needle 1 has an eyelet in the midportion thereof through which a horizontal poker 2 is loosely inserted. The poker 2 is displaced in the vertical direction with the above reciprocation of the dropper needle 1, but is freely movable, separately from the latter, in the horizontal direction.

One end of the poker 2 is inserted into the interior of a pusher box 3 through an aperture 3*a* provided on a side wall of the pusher box 3. The aperture 3*a* has enough of a clearance relative to the poker 2 so that the poker 2 can move from the lower position, corresponding to the first position, to the upper position, corresponding to the second position, following the movement of the dropper needle 1.

The pusher box 3 has a plurality of pushing elements 4 therein, each corresponding to a poker 2. In FIG. 1, only one is illustrated for the sake of simplicity. The pushing element 4 is disposed so that, when the poker 2 is in the upper position, it does not confront the end of the poker 2 and, on the other hand, when the poker 2 is in the lower position, it confronts the poker 2.

Further, the pusher box 3 is periodically reciprocated synchronously with the rotation of the main shaft of the loom in the directions shown by a double-headed arrow A in FIG. 1. According to the above description, it will be understood that the poker 2 is operated by the pushing element 4 when disposed in the lower position. This pushing motion is transmitted to a corresponding horizontal needle 5 disposed adjacent to the poker 2. The actual shedding motion follows thereafter.

The needle selection device according to the present invention will now be described.

A movable core 6 of a solenoid 30 is coaxially fixed on the upper end of the dropper needle 1. The movable core 6 is movably inserted in a tubular housing 10 of the solenoid 30 through a guiding hole 7 provided on a guide plate 8 fixed to a machine frame. The housing 10 is held between a printed board 11 and a supporting plate 12 in a sandwich manner and disposed in alignment with the dropper needle 1. The housing 10 accommodates a stationary core 9 therein. A coil 20 is wound around the housing 10, and the ends of the coil 20 are directly connected to terminals on the printed board 11.

The printed board 11 is provided with a circuit on the surface thereof, which transmits a command signal from a computer (not shown) for energizing or deenergizing the solenoid 30. The computer stores therein pattern information for weaving by a loom and outputs the above signal to each solenoid synchronously with the rotation of the main shaft.

Starting from the first position shown in FIG. 1, the dropper needle 1 is lifted to the second position by means of the cam 14 and the lifter plate 15. Along with this, the movable core 6 fixed to the upper end of the dropper needle 1 enters deeper into the housing 10 and, at the utmost stage, abuts or reaches very near to the lower end of the stationary core 9. Just at this time or slightly prior to this time, the computer outputs the command signal to the selected solenoid 30, whereby the corresponding stationary core 9 is energized to attract the corresponding movable core 6. Then, the lifter plate 15 begins to move down.

According to the downward movement of the lifter plate 15, the dropper needle 1, which has not been attracted by the solenoid, is also brought back to the first position. A spring 16 ensures a stable return motion of the dropper needle 1 even under high speed operation. The spring 16 is sheathed around the movable core 6 and arranged beneath the guide plate 8 so as to urge the movable core 6 downward. Further, the spring 16 serves to suppress the bouncing motion of the dropper needle, which results in unreliable attraction of the cores.

The selected dropper needle 1 attracted by the solenoid 30 is left in the second position, in a suspended state. Therefore, the poker 2 corresponding to the suspended dropper needle 1 is also held in the upper position where the poker 2 does not confront the pushing element 4. Thereafter, the pusher box 3 moves to the right and the poker 2 remaining in the lower position is pushed to cause the horizontal needle to operate as stated before.

After the pusher box 3 returns to the left in its waiting position, the current supplied to the solenoid is shut and the solenoid is deenergized. The suspended dropper needle then immediately drops down on the lifter plate due to its own weight and the urging force of the spring 16. The same operation is repeated synchronously with the rotation of the main shaft.

In the above embodiment, it is desired to make the distance between the first and second positions of all the dropper needles uniform even in the furthermost position so as to prevent undesired contact of cores. The distance should further be no more than 0.5 mm since attractive force generated from the stationary core is effective only within such a distance.

Figure 2:
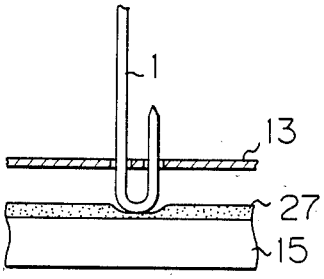
FIGS. 2 and 3 are sectional side views of part of a lifter plate provided with resilient means for receiving a dropper needle.
Figure 3:
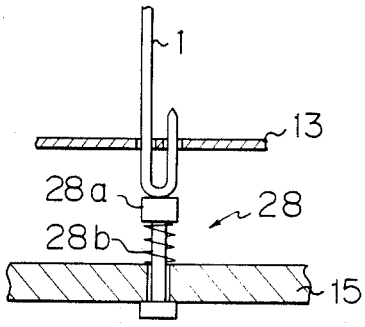

To avoid troublesome distance adjustment, as shown in FIG. 2, it is preferable to provide a resilient sheet 27 on the surface of the lifter plate 15 and to lift the dropper needle 1 until complete contact between the cores is attained. The resilient sheet will deform and absorb the shock caused by the collision of the cores. Instead of the resilient sheet 27, another cushion means 28, including a piston 28*a* urgingly held by a spring 28*b*, may be provided at the contact locations of the dropper needle 1 on the lifter plate 15 as illustrated in FIG. 3.

Figure 4:
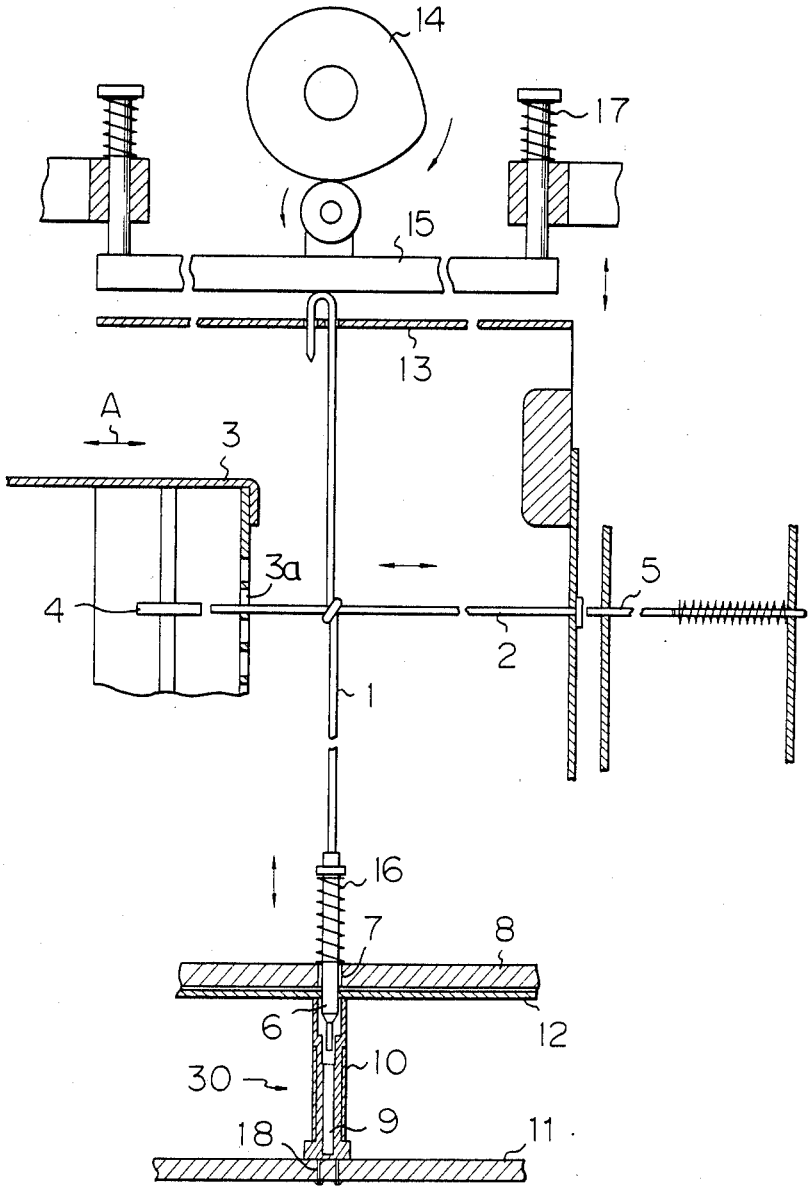
FIG. 4 is a view similar to FIG. 1, illustrating another embodiment according to the present invention.

FIG. 4 shows another embodiment of the present invention, in which the cam 14 is disposed in the upper area and the printed board 11 is in the lower area. The operational principle of the dropper needle 1 is the same as that shown in FIG. 1.

According to the present invention, a suitable number of housings 10 of the solenoids 30 are secured between the printed board 11 and the supporting plate 12 in a sandwich manner. One end of each housing 10 is fixed on the printed board 11 along with the stationary core 9 and the coil 20. The other end thereof rests on the supporting plate 12. This assembly constitutes a unit which can be handled as a single, integrated component. A plurality of such components can be put together to form a larger device. This facilitates maintenance of the mechanism. If breakage occurs, the broken component can be replaced in a short time period.

Further, as stated before, the solenoids utilized for the present invention may be small in size since they need only control lighter weight size dropper needles. Therefore, they can be arranged directly on the printed board at a smaller pitch, which eliminates the need for connection wires and enables greater compactness of the overall installation. The solenoids can in practice be arranged at a pitch of less than 5 mm.

Moreover, a plurality of printed boards 11 may be piled up to form a large device.

Figure 5:
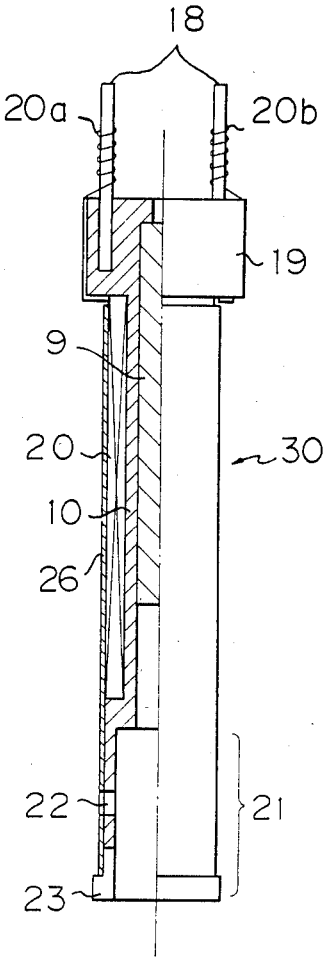
FIG. 5 is a side view of a solenoid suitable for the present invention.
Figure 6:
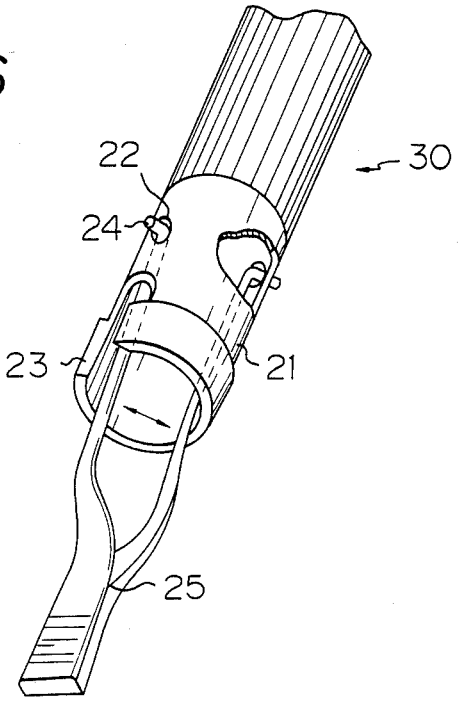
FIG. 6 is a perspective view of a solenoid engaged with a tool utilized for detachment and attachment thereof on a printing board.

FIG. 5 illustrates a strructure of an embodiment of the solenoid 30. At least two pins 18 for fixing the housing 10 on the board 11 are projected from a base end 19 of the housing 10 made of an insulation material, such as plastic. The pins 18 are connected to the beginning and terminal ends 20*a*, 20*b* of the coil 20, which is wound around a periphery of the midportion of the housing 10 in which the stationary core 9 is disposed. As shown in FIG. 6, on the side wall at the tip portion 21 of the housing 10 are provided a pair of holes 22 in a dramatically opposing manner. The holes 22 serve as holding apertures engageable with an outwardly projected end 24 of a special tool 25 utilized for pulling out the housing 10 from the printed board 11 or inserting it therein.

Further, the housing 10 preferably has a cover 26 therearound made of ferromagnetic material in order to shield the leakage of magnetic flux.

Figure 7:
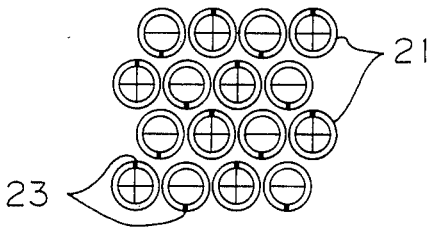
FIG. 7 is a plan view of an arrangement of the solenoids on the printed board.

As illustrated in FIG. 7, the housings 10 are preferably set in a honeycomb manner for the densest arrangement. In such a case, each solenoid 30 preferably has a reverse polarity from those of the adjacent solenoids 30 in the same row for neutralizing the interaction therebetween. For this purpose, the beginning ends 20*a* of the coils are alternately connected to the plus or minus terminal on the printed board so that the current direction is reversed in adjacent coils. A notch 23 provided on the tip end of the housing 10 serves as a mark for identifying the position of the beginning end of the coil (FIGS. 5, 6, and 7).

As stated above, according to the present invention, numerous advantages can be obtained. Since the movable cores of the solenoids are integrally connected to the dropper needles, the motion of the dropper needles can be directly controlled by the solenoids.

Since the dropper needles are light in weight, e.g., less than 10 g, and, further, are brought into contact with the stationary cores of the solenoids by the lifter plate at the time when the solenoids are to operate, the solenoids can be smaller in size and consume less power than in conventional mechanisms.

The provision of springs around the movable cores enable stabler motion of the dropper needles, thereby enabling a loom speed of from 200 to 300 rpm, compared with the 130 rpm considered maximum in conventional mechanisms.

Finally, since the solenoids are directly secured on the printed board, no wires for electric connection is needed.

We claim:

1. In a jacquard mechanism for controlling a shedding motion or warps set on a loom, comprising a plurality of axially displaceable dropper needles, each associated with a horizontal needle relating to a group of said warps, and a plurality of solenoid, each corresponding to one of said dropper needles, said control being carried out by selectively energizing said solenoids to hold the corresponding dropper needles by a command from a computer, an improvement comprising, a printed board on which a circuit for transmission of a command signal from said computer to said solenoids is printed, solenoids comprising stationary cores, accommodated in housings secured, along with coils, directly on said printed board and disposed at predetermined position along extensions of axes of said dropper needles, and movable cores fixed to ends of said dropper needles closer to said stationary cores;

means for periodically reciprocating all of said dropper needles along each longitudinal axis thereof from a first position where said movable and stationary cores are apart from each other at a predetermined distance to a second position where said movable and stationary cores substantially come into contact with each other;

a guide plate provided with a plurality of holes for stably guiding said movable cores during said reciprocation of said dropper needles; and means for urging said dropper needle toward said first position for facilitating the return thereto.

2. An improvement according to claim 1, in which said reciprocating means for the dropper needles comprises a lifter plate, for supporting said dropper needles at an opposite end to that connected to said stationary cores, and cam means, for moving said lifter plate.

3. An improvment according to claim 2, in which said lifter plate is covered with a resilient sheet on the surface receiving said dropper needles for compensating for variance of an actual distance between the first and second positions of said dropper needles.

4. An improvement according to claim 2, in which said lifter plate is provided with cushion means at the respective contact locations of said dropper needles on said lifter plate for compensating for variance of an actual distance between the first and second positions of said dropper needles.

5. An improvement according to claim 1, in which said dropper needle urging means comprises compression springs, one of the ends thereof being fixed on said guide plate and the other to said dropper needles.

6. An improvement according to claim 1, in which said solenoids are arranged in alternating polarities in each row.

7. An improvement according to claim 6, in which said housings are provided with marks at free end surfaces for identifying a position of beginning ends of said coils wound therearound.

8. An improvement according to claim 1, in which said housings of said solenoids comprise shields made of a ferromagnetic material for preventing leakage of magnetic flux therefrom.

* * * * *